US009239161B2

(12) United States Patent
Jigamian et al.

(10) Patent No.: US 9,239,161 B2
(45) Date of Patent: Jan. 19, 2016

(54) COUPLING FOR A SEALED, LOCKABLE BATTERY PACK AND POWER ADAPTER AND A HIGH INTENSITY SEARCH LIGHT

(71) Applicant: Surefire LLC, Fountain Valley, CA (US)

(72) Inventors: Gregory Z. Jigamian, Temecula, CA (US); David Parrott, Escondido, CA (US)

(73) Assignee: Surefire LLC., Fountain Valley, CA (US)

( * ) Notice: Subject to any disclaimer, the term of this patent is extended or adjusted under 35 U.S.C. 154(b) by 295 days.

(21) Appl. No.: 13/889,022

(22) Filed: May 7, 2013

(65) Prior Publication Data

US 2014/0334138 A1 Nov. 13, 2014

(51) Int. Cl.

| | |
|---|---|
| ***F21L 4/00*** | (2006.01) |
| ***F21V 31/00*** | (2006.01) |
| *F21V 23/02* | (2006.01) |

(52) U.S. Cl.

CPC ..... *F21V 31/005* (2013.01); *F21L 4/005* (2013.01); *F21V 23/026* (2013.01); *Y10T 29/49117* (2015.01); *Y10T 29/532* (2015.01)

(58) Field of Classification Search

CPC ..... F21V 23/026; F21V 31/005; F21L 4/005
USPC ..... 362/208, 157, 158, 202, 203, 207, 187, 362/194

See application file for complete search history.

(56) References Cited

U.S. PATENT DOCUMENTS

| | | | | | |
|---|---|---|---|---|---|
| 3,924,116 | A * | 12/1975 | Brindley | 362/158 |
| 4,357,648 | A * | 11/1982 | Nelson | 362/183 |
| 5,091,611 | A * | 2/1992 | Reeves et al. | 200/60 |
| 5,422,798 | A * | 6/1995 | Osiecki et al. | 362/206 |
| 8,157,407 | B2 * | 4/2012 | Palmer et al. | 362/197 |
| 8,469,540 | B1 * | 6/2013 | Gregory et al. | 362/205 |
| 2003/0189826 | A1 * | 10/2003 | Yoon | 362/205 |
| 2005/0207148 | A1 * | 9/2005 | Maglica | 362/197 |
| 2006/0039139 | A1 * | 2/2006 | Maglica et al. | 362/202 |
| 2007/0258236 | A1 * | 11/2007 | Miller | 362/205 |
| 2010/0033963 | A1 * | 2/2010 | Maglica et al. | 362/208 |
| 2011/0012535 | A1 * | 1/2011 | West et al. | 315/307 |
| 2011/0254450 | A1 * | 10/2011 | Bergholz et al. | 315/121 |

* cited by examiner

*Primary Examiner* — Nimeshkumar Patel
*Assistant Examiner* — Kevin Quarterman
(74) *Attorney, Agent, or Firm* — Daniel L. Dawes; Marcus C. Dawes

(57) ABSTRACT

A coupling for a powered search light includes a body that has a power device that provides electrical power or access to electrical power and a head coupled to the body including an lighting device which provides light when electrically powered. An end is coupled to or included as part of the body. A receiving coupling is coupled to or included as part of the head. A plurality of tabs are defined on the end and extending radially therefrom. A corresponding plurality of flanges are defined in the receiving coupling and extending radially inward therefrom. The end is arranged and configured to engage the receiving coupling by capture of the plurality of tabs by the corresponding plurality of flanges. A lock locks the plurality of tabs with respect to the plurality of flanges.

6 Claims, 11 Drawing Sheets

COUPLING FOR A SEALED, LOCKABLE BATTERY PACK AND POWER ADAPTER AND A HIGH INTENSITY SEARCH LIGHT

BACKGROUND

1. Field of the Technology

The disclosure relates to the field of battery packs and adapters for high intensity search lights and the features by which they are locked and sealed to the light head.

2. Description of the Prior Art

High intensity handheld or mounted lights, such as flashlights, headlamps, weapon lamps, fire rescue lamps, helmet lights, law enforcement lights and similar devices must be rugged, well-built, reliable and usable in demanding environmental conditions and abusive handling without failure or degradation of performance. In the case of lights, which are battery powered or coupled to power adapters, the connection to the battery pack and adapter must similarly be rugged, well-built, easily manipulated and reliable in strenuous environments that may include water, fluids, sand, dust and other particulate debris.

What is needed is a design for a battery pack or power adapter for a lighting head that fulfills the above demands.

BRIEF SUMMARY

A coupling for a powered search light includes a body that has a power device that provides electrical power or access to electrical power and a head coupled to the body including an lighting device which provides light when electrically powered. An end is coupled to or included as part of the body. A receiving coupling is coupled to or included as part of the head. A plurality of tabs are defined on the end and extending radially therefrom. A corresponding plurality of flanges are defined in the receiving coupling and extending radially inward therefrom. The end is arranged and configured to engage the receiving coupling by capture of the plurality of tabs by the corresponding plurality of flanges. A lock locks the plurality of tabs with respect to the plurality of flanges.

The coupling further includes a seal provided in either receiving coupling of the head or end of the body to seal the body and head together from the ambient environment when the body and head are coupled with each other.

The seal is a compression seal. The compression seal includes an O-ring carried in the receiving coupling and bearing against the end. The coupling further includes a second compression seal between the end and receiving coupling including an O-ring carried in the end and bearing against the receiving coupling.

The power device is a battery pack in one embodiment and an adapter and wiring harness in another embodiment.

The coupling includes a stop where a selected one of the flanges has the stop provided therein to limit rotation in a first direction of a corresponding one of the tabs engaging the selected one of the flanges. The lock is a spring loaded post arranged and configured to limit rotation in a second direction opposite to the first direction of the corresponding one of the tabs engaging the selected one of the flanges, so that the corresponding one of the tabs is locked between the stop and the post.

The coupling further includes a release coupled to the post for allowing selective removal of the post from interference contact with the corresponding one of the tabs to allow the corresponding one of the tabs to rotate in the second direction out of engagement with the selected one of the flanges.

Each of the plurality of tabs has a nose, which is a leading surface which first contacts a corresponding one of the flanges when the tabs are rotated behind the flanges. The nose is tapered to allow each of the tabs to be wedged behind the corresponding flange.

The scope of the invention also includes a method of coupling a body of a powered search light, the body including a power device that provides electrical power or access to electrical power to a head including an lighting device which provides light when electrically powered includes the steps of providing an end coupled to or included as part of the body, providing a receiving coupling coupled to or included as part of the head, fully inserting a plurality of tabs defined on the end and extending radially therefrom into open angular intervals defined between a corresponding plurality of flanges defined in the receiving coupling and extending radially inward therefrom, rotating the fully inserted end in the receiving coupling to capture the plurality of tabs by the corresponding plurality of flanges, and locking the plurality of tabs with respect to the plurality of flanges.

The method further includes the step of sealing the receiving coupling of the head with the end of the body from the ambient environment.

The step of sealing includes creating a compression seal. The step of creating the compression seal includes compressing an O-ring carried in the receiving coupling against the end.

The method further includes the step of creating a second compression seal between the end and the receiving coupling including an O-ring carried in the end and bearing against the receiving coupling.

The step of providing the power device includes providing a battery pack and/or providing an adapter and wiring harness.

The method further includes the steps of providing a stop, limiting rotation in a first direction of a corresponding one of the tabs engaging the selected one of the flanges using the stop, providing a resiliently biased post, rotating the corresponding one of the tabs past the post, and limiting rotation in a second direction opposite to the first direction of the corresponding one of the tabs engaging the selected one of the flanges using a resiliently biased post, so that the corresponding one of the tabs is locked between the stop and the post.

The method further includes the step of releasing the post to allow selective removal of the post from interference contact with the corresponding one of the tabs to allow the corresponding one of the tabs to rotate in the second direction out of engagement with the selected one of the flanges.

Each of the plurality of tabs has a tapered nose, which is a leading surface which first contacts a corresponding one of the flanges. The method includes the steps of rotating the tabs behind the flanges, wedging each of the tabs behind the corresponding flange, and creating a longitudinal displacement of the tabs and end toward the receiving coupling using the tapered nose of each of the tabs to create a compression seal between the end and receiving coupling.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
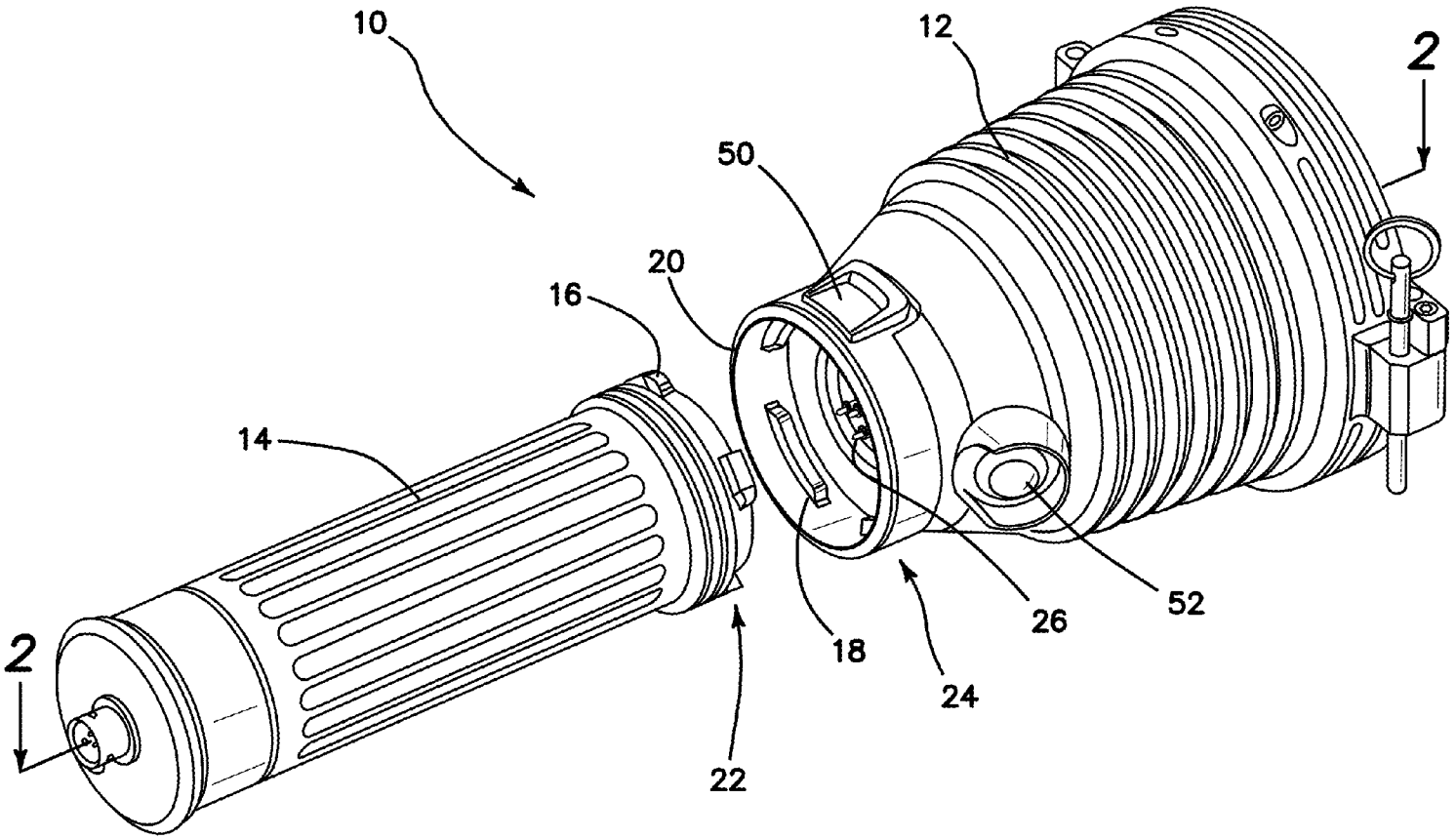
FIG. 1 is a perspective view of a disassembled light head and battery pack according to one embodiment of the invention.

FIG. 1 illustrates an embodiment wherein the invention is implemented. A high intensity handheld or mounted light 10, such as a flashlight, headlamp, weapon lamp, fire rescue lamp, helmet light, or law enforcement light, includes a light head 12 and a power connector or battery pack 14, which is connected to the head 12. FIG. 1 is a perspective view of an embodiment showing a battery pack 14 disconnected from its corresponding head 12. Locations toward the right end of the illustration of FIG. 1 are defined as distal and locations toward the left end of the illustration of FIG. 1 are defined as proximal, suggestive of the usual usage of the light 10 when manually held by pack 14 with head 12 pointed away from the user's hand. Head 12 includes the high intensity plasma lamp, electronics, filter, reflector and other optical and electrical components, which shall not be further discussed except to the extent that they might be relevant to the disclosure of the coupling or connection of pack 14 to head 12. Pack 14 includes a plurality of locking tabs 16 radially extending from the distal end 22 of pack 14. Tabs 16 are inserted into a receiving coupling 20 defined in the proximal end 24 of head 12 and are rotated to lock under a corresponding plurality of internal flanges 18 extending radially inward of receiving coupling 20. When locked in ring electrodes (not shown) on the distal end of pack 14 will make electrical and physical contact with spring loaded electrical pins 26 provided in the proximal end 24 of receiving coupling 20, whereby power and other electrical signals are coupled into head 12 from pack 14 and/or from other sources coupled thereto through pack 14, if needed. The details of the electrical coupling between pack 14 and head 12 may be varied according to the needs of the embodiment and are independent of the mechanical coupling between pack 14 and head 12.

Figure 2:
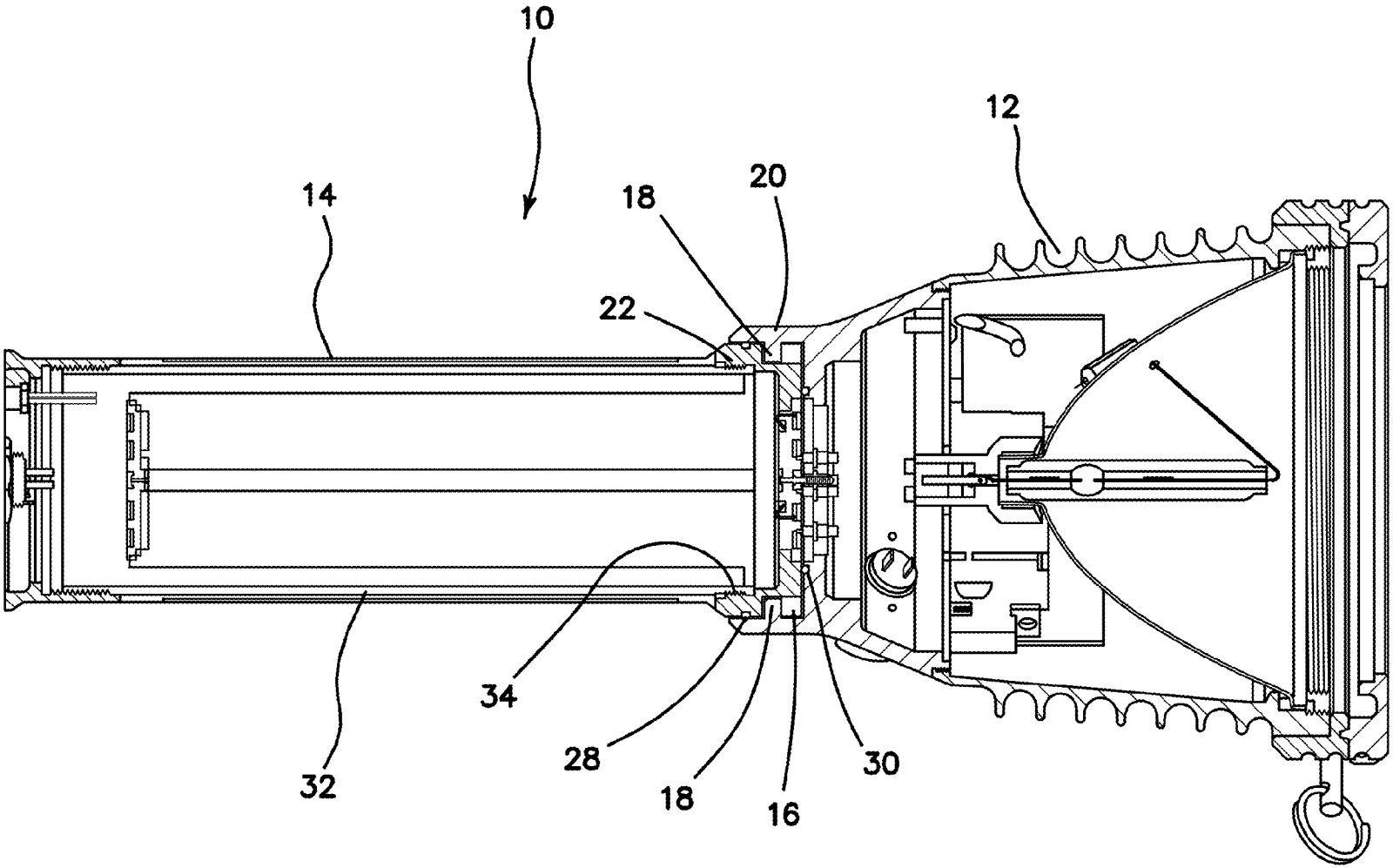
FIG. 2 is a longitudinal cross sectional view of the embodiment of FIG. 1 shown in an assembled configuration.

FIG. 2 is a longitudinal cross sectional view of the embodiment of FIG. 1 taken through section lines 2-2 in FIG. 1 as would be seen when pack 14 and head 12 are connected to each other. The various internal elements of head 12 can be seen and will not be discussed, since their details are not materially relevant to the connection of head 12 and pack 14 as discussed herein. FIG. 2 shows that proximal end 22 of pack 14 is in the form of a screw cap which is coupled to the body 32 of pack 14 by means of threading 34. End 22 is sealed with respect to receiving coupling 20 by means of an O-ring 28 carried in a radial O-ring groove defined into end 22, which O-ring 28 bears against the inner proximal surface of receiving coupling 20. The distal face 23 of end 22 is also provided with a second O-ring 30 carried in a radial O-ring groove defined into the proximal surface 25 of receiving coupling 20, which O-ring 30 bears against the outer distal surface 23 of end 22. Thus, the coupling of pack 14 with head 12 is sealed, so that it is waterproof, dustproof, impervious to sand and micro-particles of debris, when head 12 and pack 14 are coupled together as described more completely below.

Figure 2A:
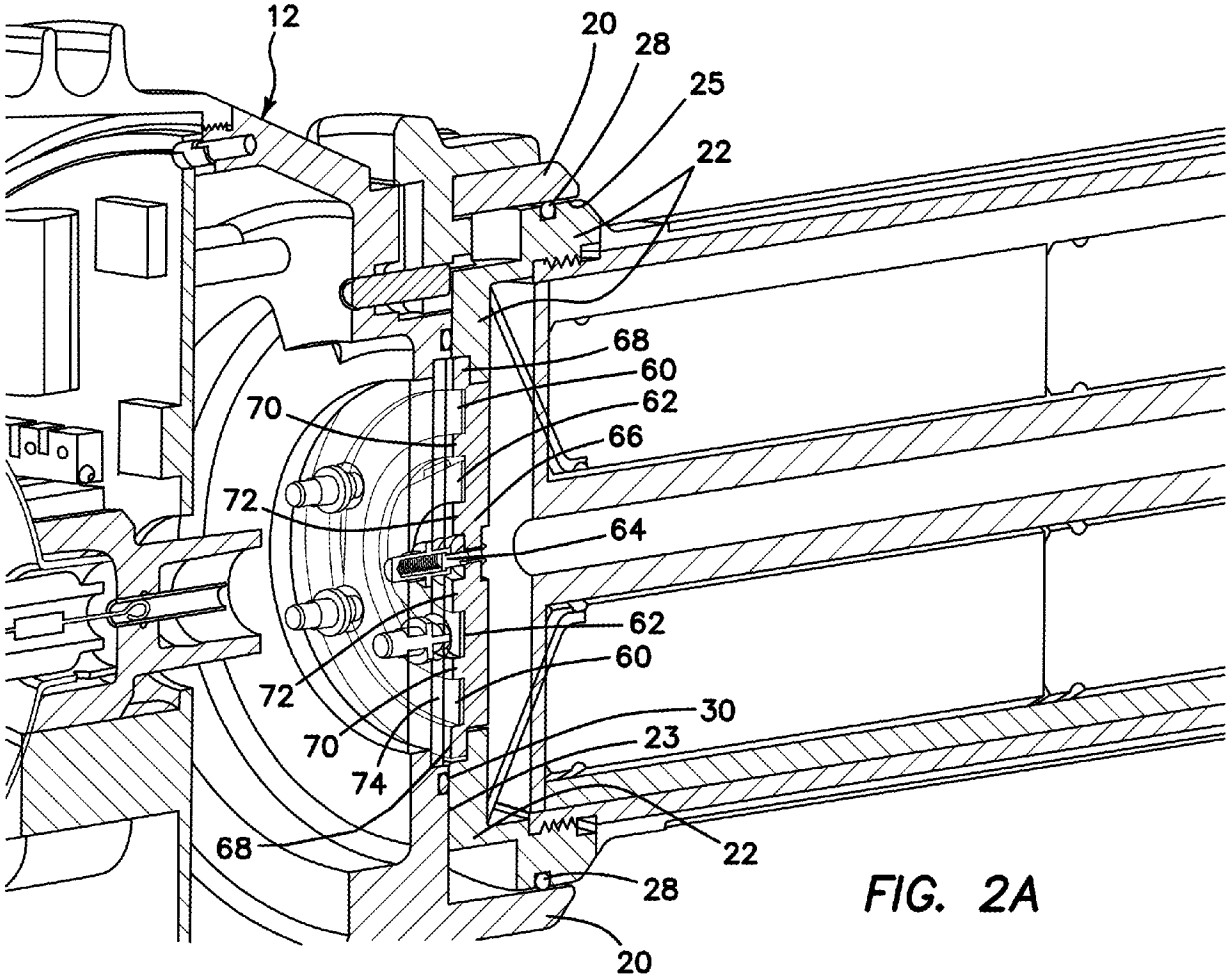
FIG. 2*a* is an enlarged longitudinal cut-away perspective view of the embodiment of FIG. 1 showing the sealing of the battery pack with the head of the light.

FIG. 2*a* is an enlarged longitudinal cut-away perspective view of the coupled head 12 with pack 14 and illustrates the sealing of O-ring 28 carried in end 22 with receiving coupling 20 and the sealing of O-ring 30 carried in receiving coupling 20 with end 22. It is entirely with the scope of the invention that the role of end 22 and coupling 20 with respect to carrying O-rings 28 and 30 could be reversed from that shown, i.e. O-ring 28 carried in coupling 20 and O-ring 30 carried in end 22.

FIG. 2*a* also illustrates an additional feature of the invention wherein shorting across the electrodes of the battery pack 14 is substantially avoided. As seen in FIG. 2*a* an outer ring electrode 60, an intermediate ring electrode 62 and center pin receptacle electrode 64 for coupling to an opposing pin electrode in the head 12 are disposed on an insulating plate 64 forming part of the end cap of pack 14. Electrical connection through plate 66 is provided to the batteries in pack 14 through conductors not shown in FIG. 2*a*. Surrounding electrodes 60, 62 and 64 are insulating ring 68 outside of electrode 60, insulating ring 70 between electrode 60 and electrode 62, and insulating ring 72 surrounding electrode 64. Rings 68, 70 and 72 extend beyond the surfaces of electrodes 60, 62 and 64 so that electrodes 60, 62 and can be said to be nested inside of or within rings 68, 70 and 72. In the illustrated embodiment insulating rings 68, 70 and 72 are integral extensions of insulating plate 66, although this need not be the case, and rings 68, 70 and 72 could be separate and affixed to plate 66. Insulating rings 68, 70 and 72 may be flush and in contact with plate 74 of head 12 or be spaced therefrom at illustrated in FIG. 2*a*. In any case, insulating rings 68, 70 and 72 serve as a means of preventing electrodes 60, 62 and 64 from being short circuited when pack 14 is removed from head 12. The electrode or electrically active end of pack 14 can then be place face down on a conducting surface and electrodes 60, 62 and 64 will not be short circuited by such a placement. A conductive tool, wire or element that may be inadvertently laid over the electrically active end of pack 14 similarly will not result in short circuiting the electrodes 60, 62 and 64 and thereby causing damage to or discharge of pack 14.

Figure 3:
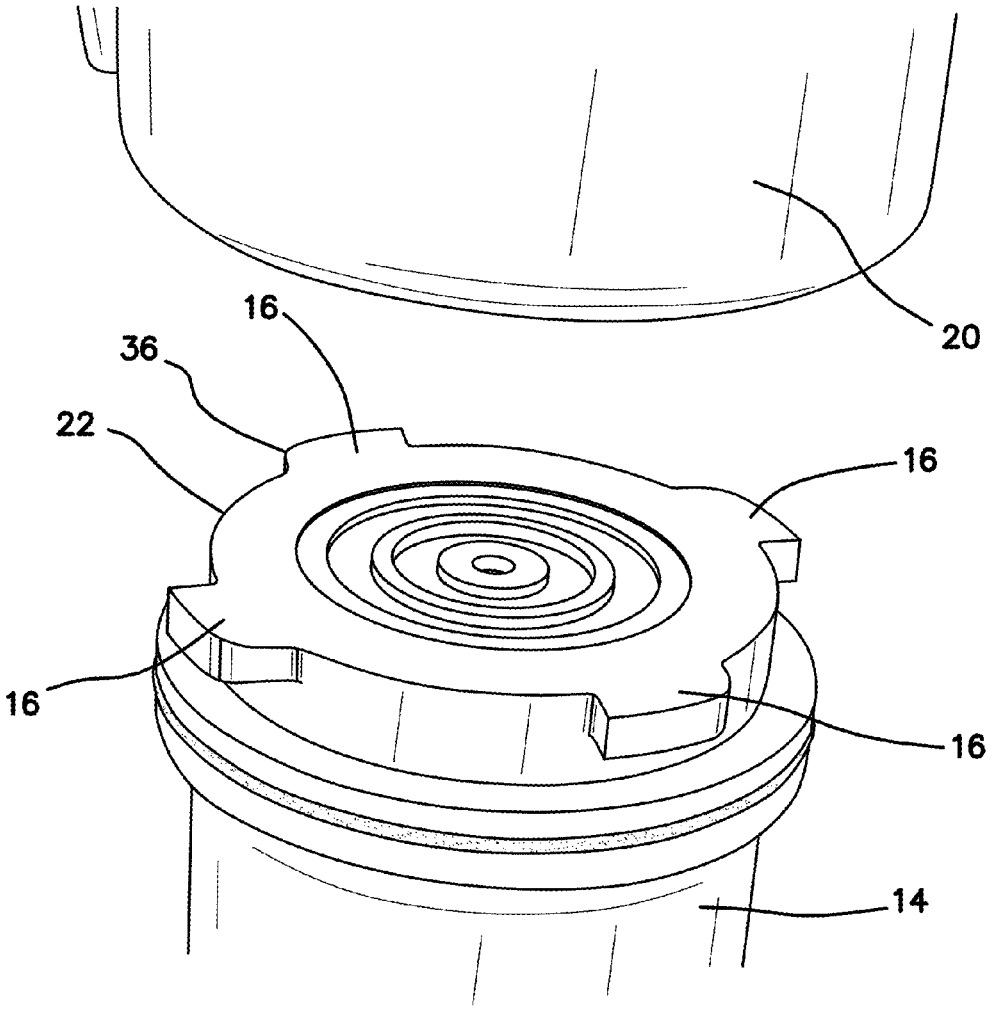
FIG. 3 is an enlarged perspective view of the top of the battery pack coupling shown in FIGS. 1 and 2.

In the cross section of FIG. 2 it can be seen that one of the plurality of tabs 16 of pack 14 has been rotated underneath flange 18 of coupling 20, thereby connecting head 12 and pack 14 together and providing the force to seal O-ring 30 against end 22. Additional detail in the shape and arrangement of tabs 16 on end 22 can be seen in the top perspective view of FIG. 3. In the illustrated embodiment, four tabs 16 are provided, but the number of tabs 16 may be increased or decreases as desired.

Figure 4:
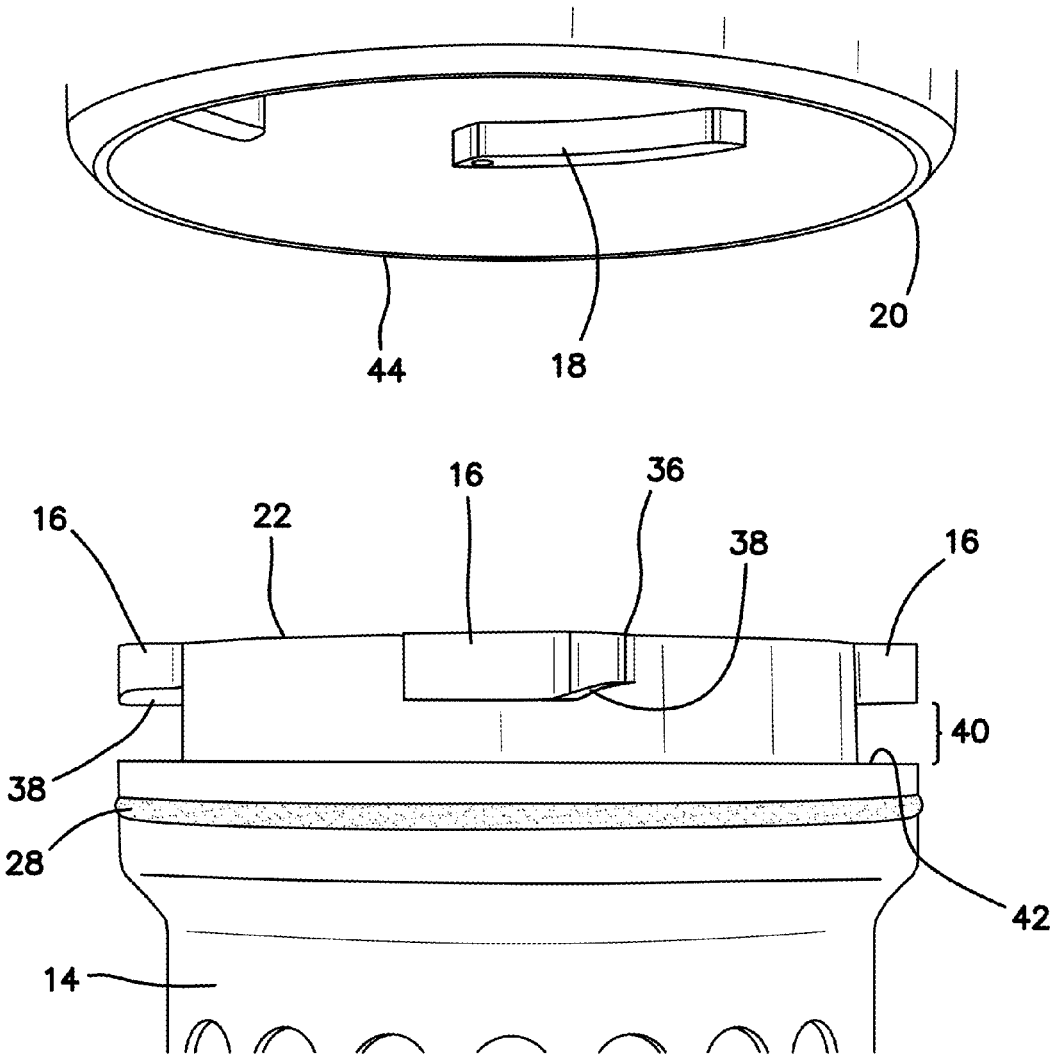
FIG. 4 is an enlarged side plan view of the top of the battery pack coupling shown in FIGS. 1-3.

As better depicted in the side plan elevational view of FIG. 4 tab 16 extends radially outward from end 22 and has its distal surface flush with the distal surface of end 22. Tab 16 is provided with a contoured leading nose 36, which has a taper 38 defined on its proximal surface. FIG. 4 shows a perspective view of corresponding flanges 18 provided in the inner surface of coupling 20. When connected, tab 16 is inserted into receiving coupling 20 between flanges 18 so that its proximal surface is parallel to the distal surface of flange 18. This positioned is automatically achieved when end 22 is fully inserted into receiving coupling 20 as defined by the distance 40 between the proximal surface of tab 16 and the distal surface of shoulder 42 defined in end 22. Full insertion is defined by the contact of proximal edge 44 of coupling 20 against shoulder 42. When full insertion is achieved, end 22 and coupling 20 are rotated relative to each other to rotate tab 16 above flange 18 as seen in the depiction of FIG. 4. In this configuration pack 14 is securely connected to head 12.

Figure 5A:
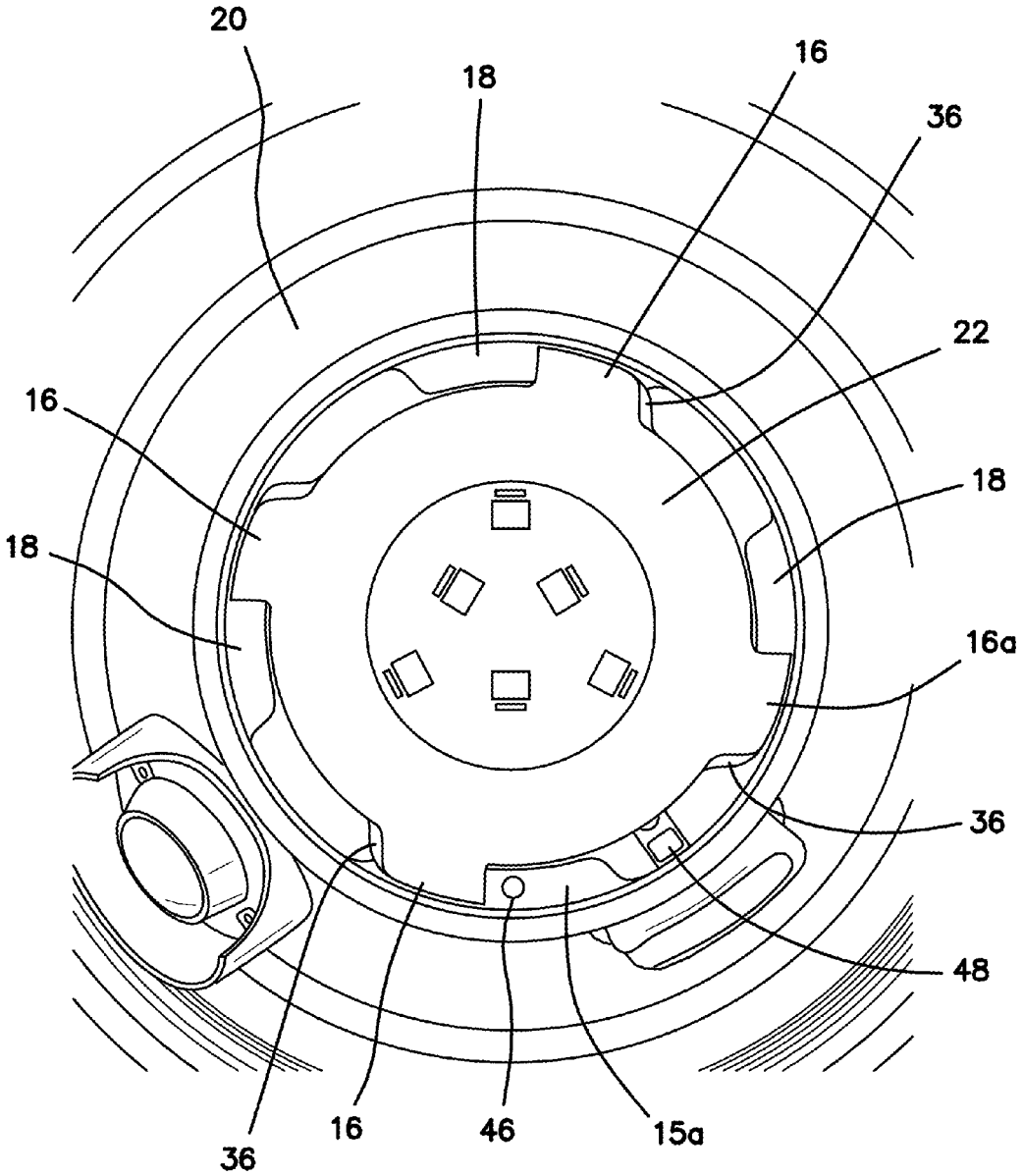
FIG. 5*a* is an enlarged cross sectional end view of the top of the battery pack coupling of FIGS. 1-4 disposed into the receiving fixture of the light head in an unlocked configuration.
Figure 5B:
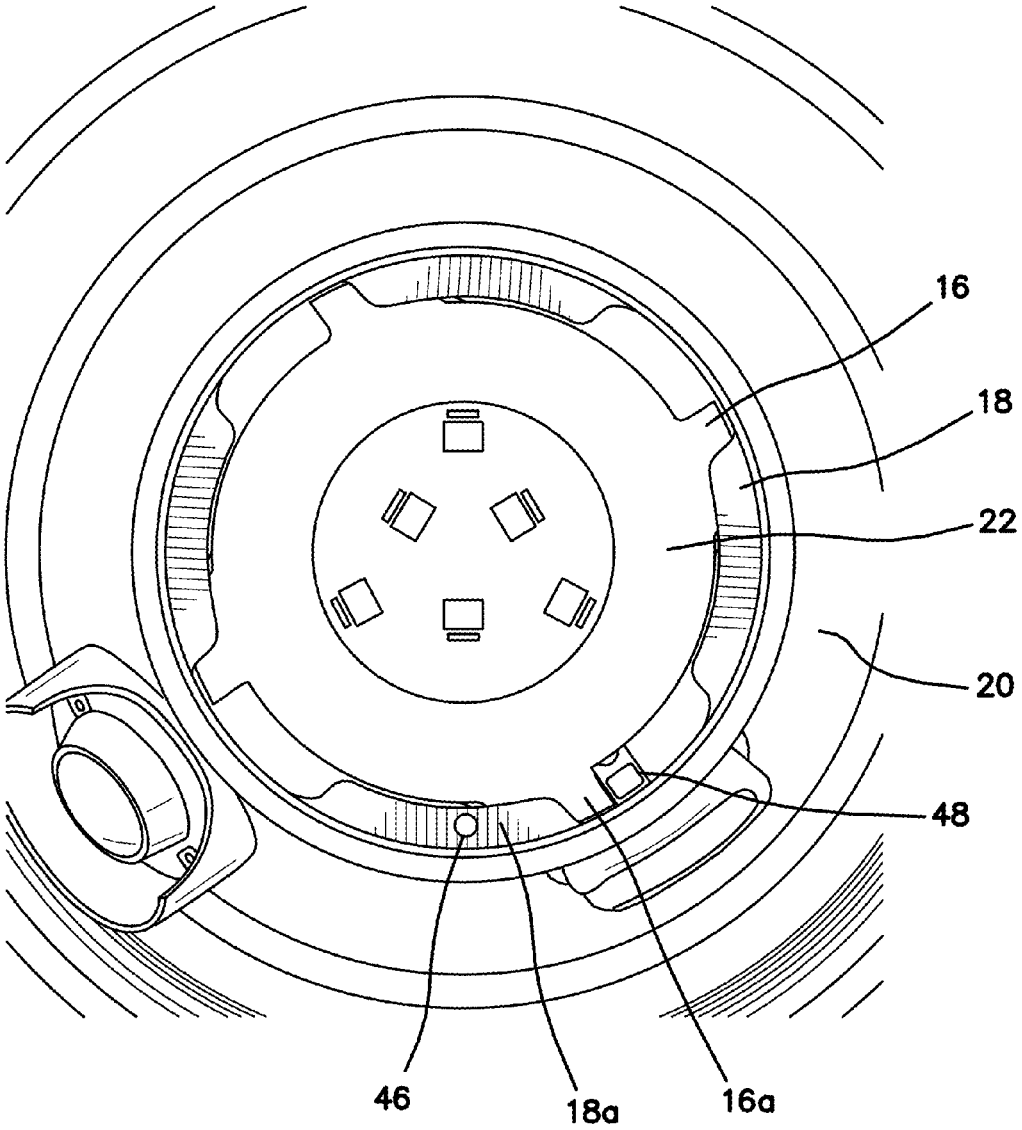
FIG. 5*b* is an enlarged cross sectional end view of the top of the battery pack coupling of FIGS. 1-4 disposed into the receiving fixture of the light head in a locked configuration.
Figure 6:
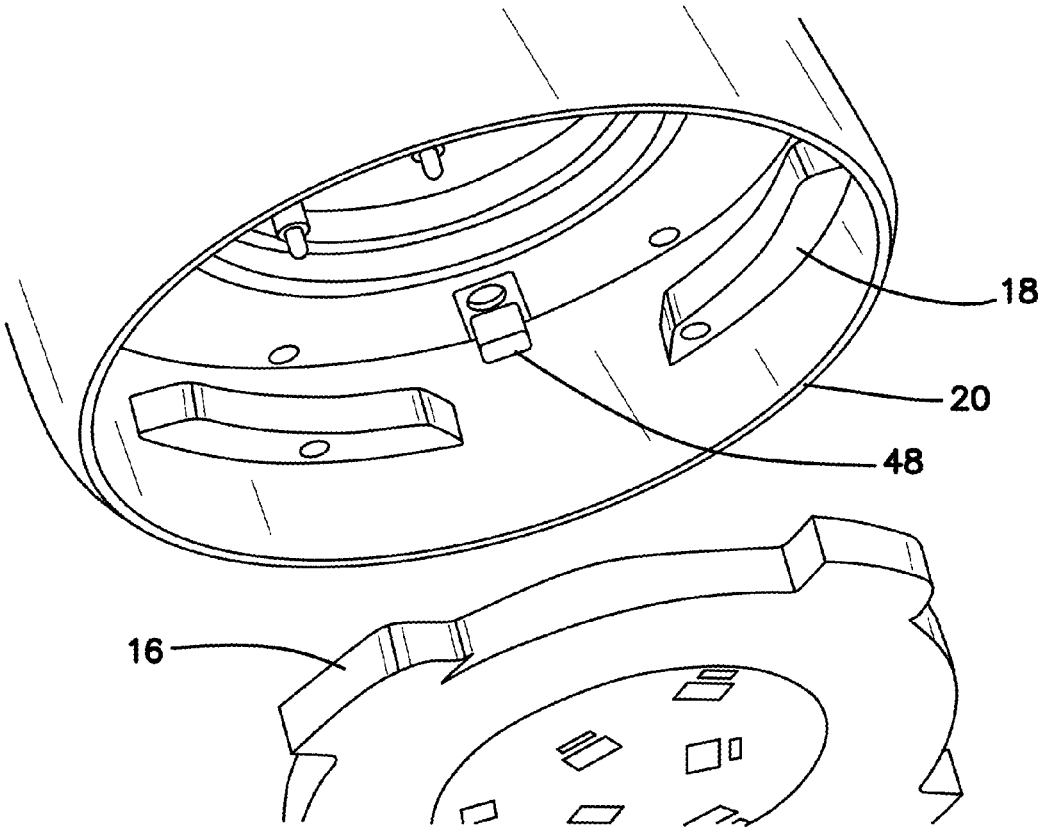
FIG. 6 is an enlarged perspective view of the top of the battery pack coupling and the receiving fixture defined in the light head of FIGS. 1-4.

This connection and the locking of pack 14 and head 12 together are better understood by viewing the configurations shown in FIGS. 5*a*, 5*b* and 6. FIG. 5*a* is perpendicular cross sectional view of end 22 as viewed distally with end 22 and tabs 16 fully inserted into receiving coupling 20, showing tabs 16 disposed between flanges 18 in the open angular intervals between adjacent flanges 18. In this configuration the proximal surfaces of tabs 16 visible in FIG. 5*a* will be parallel to or nearly parallel to the distal surfaces of flanges 18 (not visible in FIG. 5*a*) within the designed tolerance of 0.014±0.005 inch (0.036±0.013 cm). Tabs 16 may be initially inserted into any angular position in the open angular intervals between adjacent flanges 18. In the illustration of FIG. 5*a* by example only, tabs 16 are shown as inserted in the far end of the open angular intervals between adjacent flanges 18, so that tabs 16 will be rotated clockwise as seen in FIG. 5*a* toward the opposing flange 18. For example, tab 16*a* will be manually rotated toward flange 18*a*.

Upon being rotated clockwise in FIG. 5*a*, nose 36 will align with opposing flange 18 and taper 38 of nose 36 will facilitate the sliding engagement of the proximal surface of tab 16 with the distal surface of flange 18, allowing tab 16 is easily and positively slide over flange 18 as viewed in FIG. 4. Tab 16 is manually rotated until it reaches its fully tucked position as shown in FIG. 5*b*. A pin 46 is provided in one of the flanges 18, flange 18*a* for example, which acts as a mechanical stop. Pin 46 is press fit into a bore defined through flange 18*a* and extends from its distal surface to or toward the opposing proximal surface of coupling 20 above flange 18*a*. Nose 36 of tab 16*a* will thus eventually be manually rotated into an interference contact with pin 46, at which further rotation of end 22 will be prevented and tabs 16 will be fully tucked above flanges 18.

As shown in FIGS. 5*a* and 5*b* and as better illustrated in the perspective view of FIG. 6, a spring loaded locking post 48 is provided at a predetermined angular position to the right of flange 18 in the depiction of FIGS. 5*a* and 5*b*. As tapered nose 36 is rotated toward and over post 48 it depresses post 48 into coupling 20, thereby allowing the rotation of tab 16 over and past post 48. As the after edge of tab 16*a* clears post 48, the compression spring under post 48 (not shown) automatically forces post 48 proximally or downwardly to its fully extended configuration. As shown in FIG. 5*b* the position of pin 46, the angular width of tab 16*a* and the angular position of post 48 is chosen such that tab 16*a* is securely confined within tolerances between pin 46 and post 48 and is not allowed to rotate in either the clockwise or counterclockwise directions. In the configuration of FIG. 5*b*, pack 14 is then connected and locked to head 12.

FIG. 1 illustrates in perspective view a lock release slide 50, which is mechanically coupled to post 48. Button 52 is an on/off button for electrical control of head 12. When slide 50 is manually pushed distally, it acts against the spring which urges post 48 outward and withdraws post 48 into coupling 20 until its proximal surface is flush or below the distal surface of coupling 20 opposing flanges 18, thereby allowing tabs 16 to be manually rotated out of engagement with flanges 18 and allowing pack 14 and head 12 to be disconnected and unlocked from each other. The mechanical coupling between slide 50 may be arranged and configured by any means well known in the art.

Figure 7:
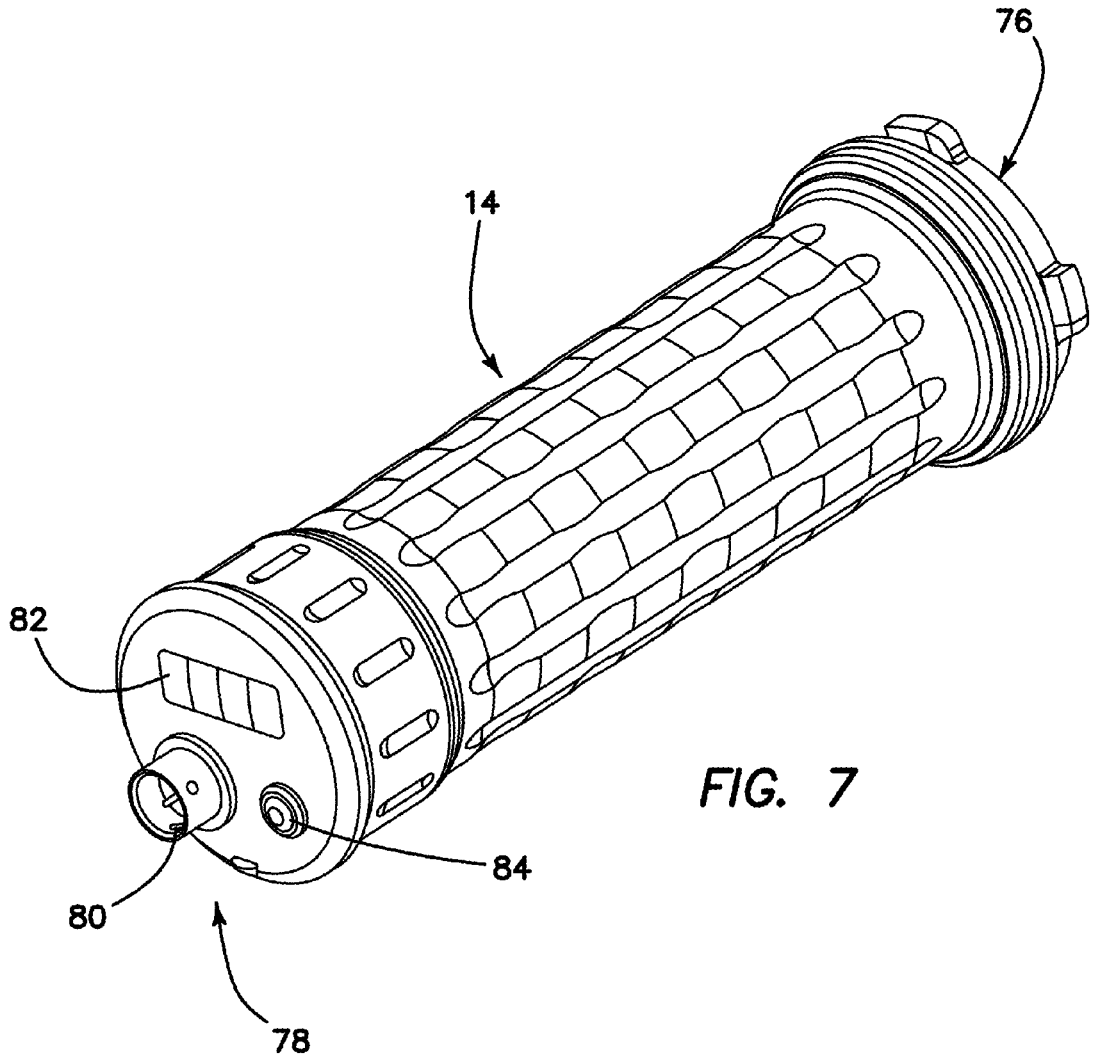
FIG. 7 is a perspective view of an embodiment of the invention wherein the battery pack coupling of the above embodiment is modified to provide a power adapter for hard-wired coupling to the light head and a display showing the state of charge of the battery pack.

FIG. 7 is a perspective view of another embodiment of pack 14 wherein the distal end 78 opposite the end 76 of pack 14 carrying electrodes 60, 62 and 64 is provided with a multiple pin connector 80 allowing for remote control and charging of the light as a whole. In addition the state of charge of pack 14 is measured by conventional means and displayed in LCD or LED display 82. In the illustrated embodiment, LED display 82 has four bars indicating whether the battery life of the light remaining is 25, 50, 75 or 100% of the specified life time of a charge on pack 14. Because continuous or uncontrolled illumination of display 82 may not be desired in all uses of the light, an on-off pushbutton switch 84 is provided to allow display 82 to be lit or not. The entire assembly 80, 82, and 84 of end 78 is sealed and waterproof for the protection of the batteries in pack 14.

Figure 8:
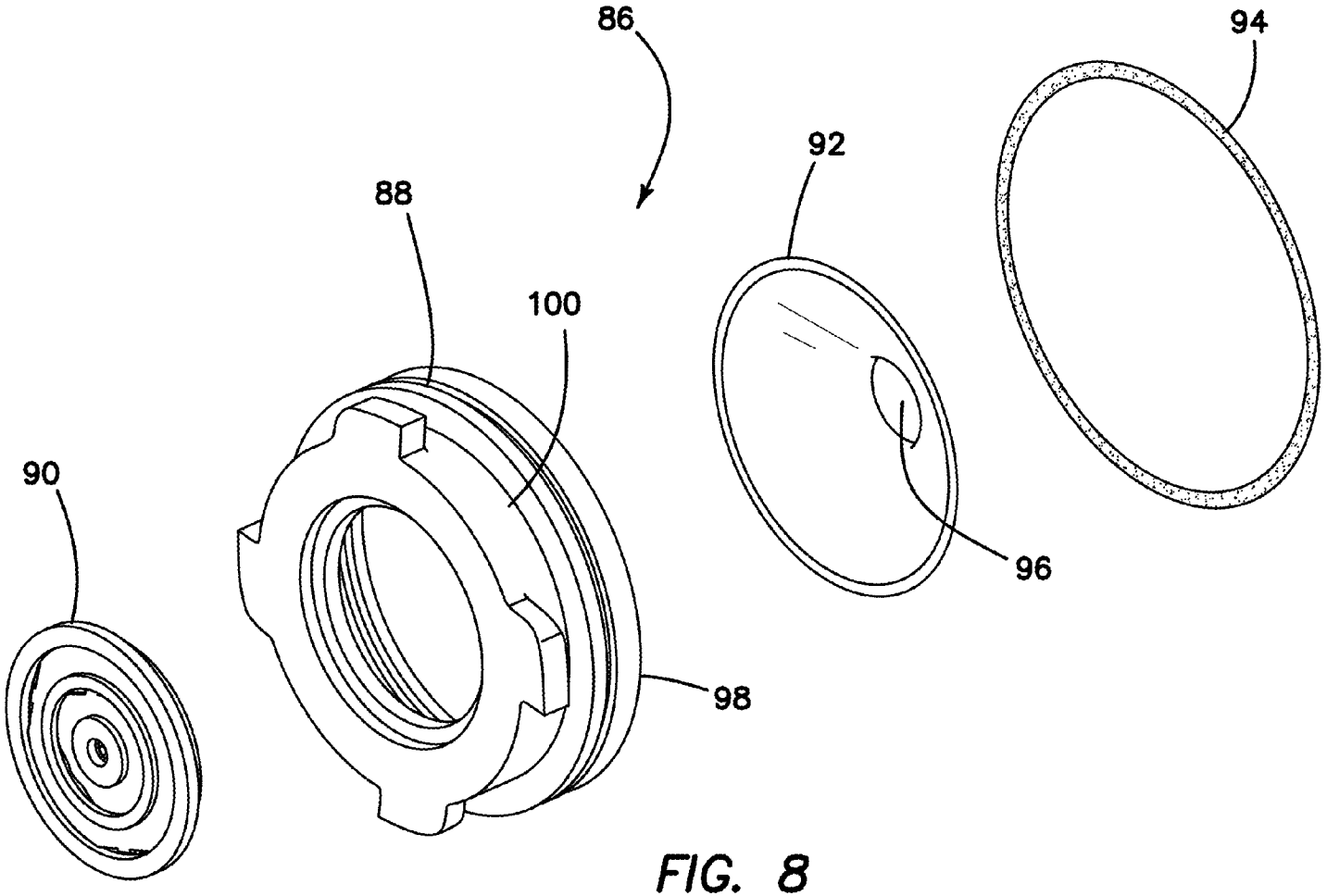
FIG. 8 is an exploded perspective view of a mount for the illumination head for use with external devices, such as a pan and tilt mechanism, gun mount or other apparatus to which the searchlight would be coupled.
Figure 10:
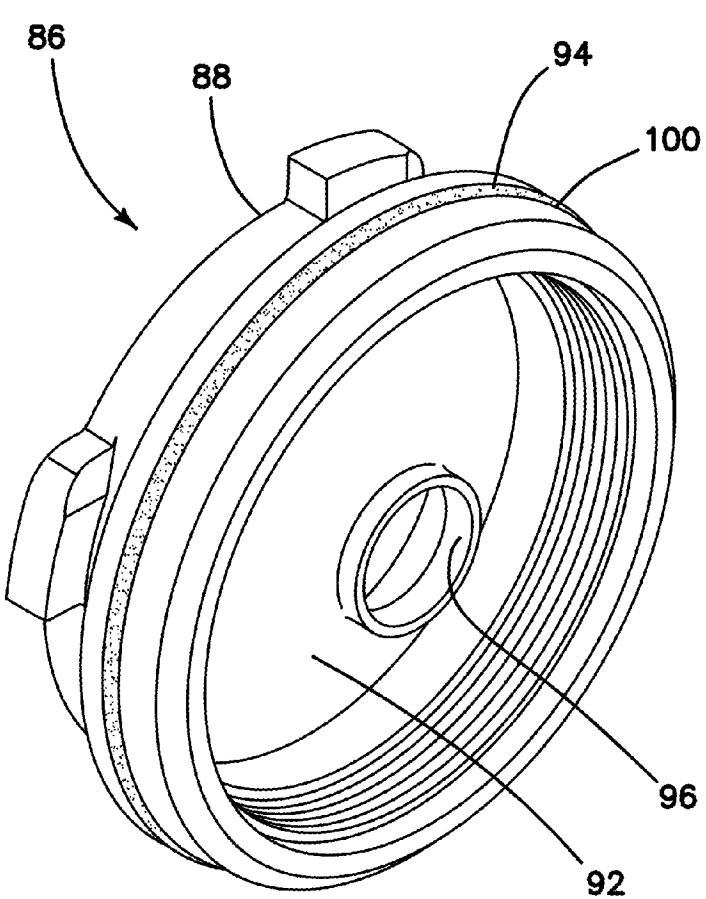
FIG. 10 is a perspective view of the rear of the mount of FIG. 8.
Figure 9:
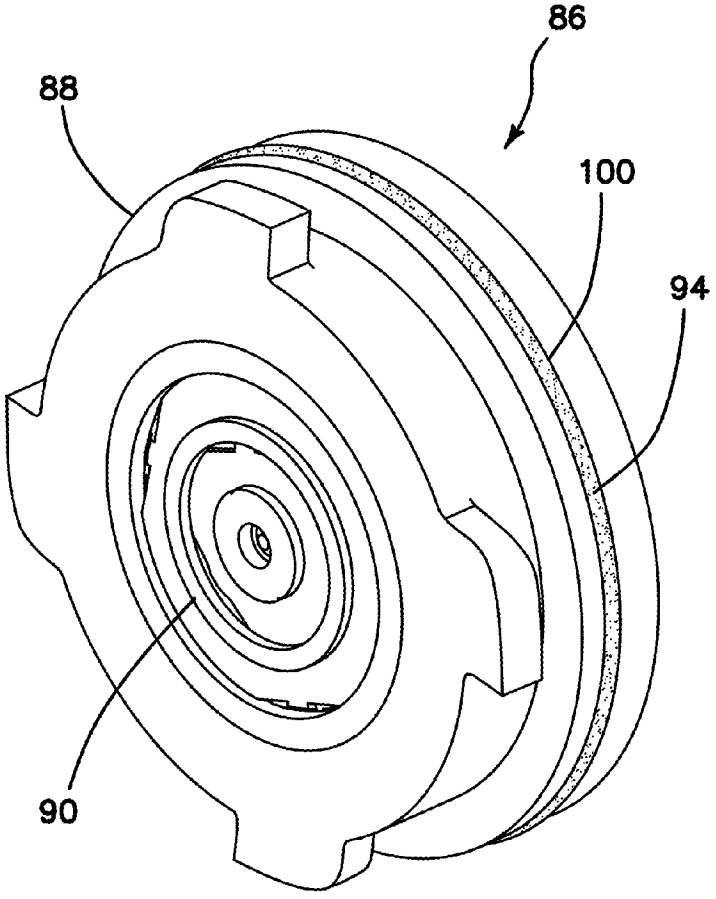
FIG. 9 is a perspective view of the front of the mount of FIG. 8.

FIGS. 8-10 are perspective views of a coupling or mount 86 wherein end 24 of illumination head 12 is not coupled to a body 32 as in the first illustrated embodiment of FIGS. 1-6, but is threaded into mount 86 so that head 12 is hardwired into an external power source, such as often used in mounted gun installations or into a pan and tilt mechanism in which the searchlight can be remotely aimed and operated. The nature of the coupling, sealing and locking between head 12 and mount 86 is otherwise substantially identical between the embodiment of FIGS. 1-6. FIG. 8 shows an exploded perspective view of mount 86, which is comprised of an adapter 88, battery contact assembly 90, cup 92 and O-ring 94. Adapter 88 is substantially identical to that shown and described in FIG. 3. The battery contact assembly 90 is substantially identical to that shown and described in FIGS. 2*a* and 3 and is epoxied to the front of adapter 88. Cup 92 is epoxied to the rear of adapter 88 and provides for sealing and protecting adapter 88 to external factors. A hole 96 is defined in the center of cup 92 to allow for the passage of wiring (not shown) from contact assembly 90 to be lead to whatever device to which mount 86 and the illumination head 12 to is to be coupled. An O-ring groove 98 is defined in the rim 100 of adapter 88 for carrying O-ring 94 to provide for a weatherproof and dust proof seal into a threaded receiving mount (not shown) on the whatever device to which mount 86 and the illumination head 12 to is to be coupled. A front perspective view of the assembled mount 86 is shown in FIG. 9 and a rear perspective view of the assembled mount 86 is shown in FIG. 10.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

We claim:

1. A coupling for a powered search light comprising:

a power body including a power device that provides electrical power or access to electrical power and having a corresponding longitudinal axis;

a lighting head coupled to the power body, the lighting head including lighting device which provides light when electrically powered and having a corresponding longitudinal axis;

where the power body has an end coupled to or included as part of the power body;

where the lighting head has a receiving coupling coupled to or included as part of the lighting head;

a compression O-ring seal provided in either receiving coupling of the lighting head or end of the power body to seal the power body and lighting head together from the ambient environment when the body and head are coupled with each other, a plurality of tabs defined on the end of the power body and extending radially therefrom;

a corresponding plurality of flanges defined in the receiving coupling of the lighting head and extending radially inward therefrom, the power end arranged and configured to engage the receiving coupling by capture of the plurality of tabs between the corresponding plurality of flanges and lighting head, when the lighting head and power body are rotated relatively to one another, the plurality of flanges and lighting head each providing rigid opposed surfaces to each other, each of the tabs being confined between the rigid surface of a corresponding one of the flanges and the opposing rigid surface of the lighting head to provide a positive capture of the tabs therebetween, the capture of the tabs by the flanges longitudinally compressing the compression O-ring seal between the lighting head and er end so that the lighting head and power end are temporarily securely pressed to ether at the same time as the positive capture of the tabs securely couple the power end to the lighting head together; and a lock for selectively locking the plurality of tabs with respect to the plurality of flanges to prevent relative rotation of the lighting head with respect to the power end.

2. The coupling of claim 1 where the power device of the power end comprises a battery pack.

3. The coupling of claim 1 where the power device of the power end comprises an adapter and wiring harness.

4. The coupling of claim 1 further comprising a stop in the lighting head and where a selected one of the flanges has the stop provided therein to limit rotation in a first direction about the longitudinal axis of a corresponding one of the tabs engaging the selected one of the flanges, the tab having opposing ends, and where the lock is a spring loaded, longitudinally movable post arranged and configured to limit rotation of the tab about the longitudinal axis in a second direction opposite to the first direction of the corresponding one of the tabs engaging the selected one of the flanges by an interference juxtapositioning of the post and stop at the opposing ends of the tab, so that the corresponding one of the tabs is rotationally locked in a position relative to the selected one of the flanges between the stop and the post.

5. The coupling of claim 4 further comprising a release coupled to the post for allowing selective removal of the post from interference contact with the corresponding one of the tabs to unlock the corresponding one of the tabs and allow the corresponding one of the tabs to rotate in the second direction out of engagement with the selected one of the flanges.

6. The coupling of claim 1 where each of the plurality of tabs has a nose, which is a leading surface which first contacts a corresponding one of the flanges when the tabs are rotated behind the flanges, and where the nose is tapered to allow each of the tabs to be wedged behind the corresponding flange.

* * * * *